US008915677B2

(12) United States Patent
Lenders

(10) Patent No.: US 8,915,677 B2
(45) Date of Patent: Dec. 23, 2014

(54) JACK-UP RIG WITH LEG-SUPPORTED BALLAST LOADS

(75) Inventors: Bernardino Lenders, Austin, TX (US); Maria Lenders, legal representative, Austin, TX (US)

(73) Assignee: National Oilwell Varco, L.P., Houston, TX (US)

( * ) Notice: Subject to any disclaimer, the term of this patent is extended or adjusted under 35 U.S.C. 154(b) by 139 days.

(21) Appl. No.: 13/635,923

(22) PCT Filed: Mar. 18, 2011

(86) PCT No.: PCT/US2011/028926

§ 371 (c)(1), (2), (4) Date: Apr. 9, 2013

(87) PCT Pub. No.: WO2011/116254

PCT Pub. Date: Sep. 22, 2011

(65) Prior Publication Data

US 2013/0189038 A1 Jul. 25, 2013

Related U.S. Application Data

(60) Provisional application No. 61/315,745, filed on Mar. 19, 2010.

(51) Int. Cl.

| | |
|---|---|
| ***E02B 17/08*** | (2006.01) |
| ***E02B 17/02*** | (2006.01) |
| ***E02B 17/06*** | (2006.01) |
| ***B63B 35/44*** | (2006.01) |
| *E02B 17/00* | (2006.01) |

(52) U.S. Cl.

CPC ..... *E02B 17/08* (2013.01); *E02B 17/021* (2013.01); *E02B 2017/0082* (2013.01); *E02B 2017/006* (2013.01); *E02B 17/06* (2013.01); *B63B 35/4413* (2013.01); *E02B 17/0818* (2013.01)

USPC ..... 405/196; 405/203; 405/205; 405/206

(58) Field of Classification Search

USPC ..... 405/196, 197, 198, 203, 205, 206, 207, 405/208

See application file for complete search history.

(56) References Cited

U.S. PATENT DOCUMENTS 3,797,256 A * 3/1974 Giblon ..... 405/196
3,934,528 A 1/1976 Horton et al.

(Continued)

FOREIGN PATENT DOCUMENTS

WO 2008094573 A1 8/2008

OTHER PUBLICATIONS

PCT/US2011/028926 International Search Report and Written Opinion dated Mar. 18, 2011 (10 p.).

*Primary Examiner* — Benjamin Fiorello
(74) *Attorney, Agent, or Firm* — Conley Rose, P.C.

(57) ABSTRACT

A jack-up rig for offshore operations comprises a hull. In addition, the rig comprises a support leg moveably coupled to the hull. The support leg has a central axis, an upper end, and a lower end opposite the upper end. Further, the support leg is adapted to be axially raised and lowered relative to the hull. The rig also comprises a ballast tank movably coupled to the support leg. The ballast tank is adapted to be axially raised and lowered relative to the support leg and the hull.

19 Claims, 6 Drawing Sheets

(56) References Cited

U.S. PATENT DOCUMENTS

| | | | | | |
|---|---|---|---|---|---|
| 4,232,983 | A | * | 11/1980 | Cook et al. | 405/210 |
| 4,365,576 | A | * | 12/1982 | Cook | 405/200 |
| 4,482,274 | A | | 11/1984 | Brandi et al. | |
| 4,604,001 | A | * | 8/1986 | Wetmore | 405/224 |
| 4,695,201 | A | | 9/1987 | Beskow et al. | |
| 4,902,169 | A | * | 2/1990 | Sutton | 405/204 |
| 4,916,999 | A | | 4/1990 | Palmer et al. | |
| 5,188,484 | A | | 2/1993 | White | |
| 5,704,731 | A | | 1/1998 | Huang | |
| 6,347,912 | B1 | * | 2/2002 | Thomas | 405/224.2 |
| 6,378,451 | B1 | | 4/2002 | Wetch et al. | |
| 6,406,223 | B1 | * | 6/2002 | Thomas | 405/224.2 |
| 6,564,741 | B2 | * | 5/2003 | Nelson | 114/264 |
| 6,830,413 | B2 | | 12/2004 | Wybro et al. | |
| 7,008,140 | B2 | | 3/2006 | Copple et al. | |
| 7,152,544 | B2 | | 12/2006 | Kryska et al. | |
| 8,070,388 | B2 | * | 12/2011 | Thomas | 405/203 |
| 2006/0051164 | A1 | | 3/2006 | Foo et al. | |
| 2009/0208294 | A1 | | 8/2009 | Yao et al. | |
| 2009/0304452 | A1 | * | 12/2009 | Bernadac | 405/196 |
| 2010/0150660 | A1 | * | 6/2010 | Nadarajah et al. | 405/196 |

* cited by examiner

JACK-UP RIG WITH LEG-SUPPORTED BALLAST LOADS

CROSS-REFERENCE TO RELATED APPLICATIONS

This application is a 35 U.S.C. §371 national stage application of PCT/US2011/028926 filed Mar. 18, 2011, which claims the benefit of U.S. provisional patent application Ser. No. 61/315,745 filed Mar. 19, 2010, and entitled "Jack-Up Rig with Leg-Supported Ballast Loads," each of which is hereby incorporated herein by reference in its entirety.

STATEMENT REGARDING FEDERALLY SPONSORED RESEARCH OR DEVELOPMENT

Not applicable.

BACKGROUND

1. Field of the Invention

The invention relates generally to offshore structures. More particularly, the invention relates to offshore platforms for drilling and production operations. Still more particularly, the present invention relates to jack-up rigs with adjustable ballast and buoyancy moveably coupled to their legs.

2. Background of the Technology

A jack-up rig is a type of mobile offshore structure equipped with long support legs that are lowered to the sea floor. A jack-up rig typically includes a floating hull, drilling rig supported on the hull, and a plurality of elongate legs coupled to the hull. The hull is typically towed to the desired offshore drilling location with its legs in a raised position. Upon arriving at the desired location, the legs are lowered to the sea floor, and the hull is jacked out of the water, thereby providing a raised platform for offshore drilling and/or production operations. The hull, which supports the drilling rig, is raised above the sea surface to a desired height, thereby allowing wave, tidal, and current loads to act on the comparatively smaller legs as opposed to the larger hull and drilling rig.

When the legs of a jack-up rig are lowered to the sea floor, they are typically "preloaded" to securely drive the legs into the sea bottom. Traditionally, the preload is provided by the weight of the hull, the weight of the drilling rig and other equipment supported by the hull, and the weight of ballast water that is added to the hull. In most cases, the ballast water is pumped into ballast tanks located within the hull. The additional weight provided by the water ballast facilitates and controls the penetration of the legs into the sea floor, thereby securely setting the jack-up rig. However, the additional weight provided by water ballast in the hull increases the total load supported by the hull and the jacking systems that move the legs relative to the hull. For a hull or jacking system having a particular maximum load capacity, the added weight of the water ballast reduces the capacity available for other equipment and/or quarters on the hull.

Accordingly, there remains a need in the art for improved systems and methods for preloading the legs of a jack-up rig. Such systems and methods would be particularly well received if they offered the potential to reduce ballast loads on the hull, thereby enabling the hull to support additional equipment and/or quarters.

BRIEF SUMMARY OF THE DISCLOSURE

These and other needs in the art are addressed in one embodiment by a jack-up rig for offshore operations. In an embodiment, the rig comprises a hull. In addition, the rig comprises a support leg moveably coupled to the hull. The support leg has a central axis, an upper end, and a lower end opposite the upper end. Further, the support leg is adapted to be axially raised and lowered relative to the hull. The rig also comprises a ballast tank movably coupled to the support leg. The ballast tank is adapted to be axially raised and lowered relative to the support leg and the hull.

These and other needs in the art are addressed in another embodiment by a method for operating an offshore jack-up rig. The rig comprises a hull and a plurality of elongate support legs moveably coupled to the hull. Each of the support legs has a central axis, an upper end, and a lower end opposite the upper end. In an embodiment, the method comprises (a) moveably coupling a ballast tank to a first of the plurality of support legs. In addition, the method comprises (b) moving the first of the plurality of support legs axially up or down relative to the hull. Further, the method comprises (c) moving the ballast tank axially up or down relative to the first of the plurality of support legs. Still further, the method comprises (d) applying a preload to the first of the plurality of support legs with the ballast tank, wherein the preload applied by the ballast tank is not applied to the hull.

These and other needs in the art are addressed in another embodiment by a method for deploying an offshore jack-up rig. In an embodiment, the method comprises (a) building the jack-up rig. The jack-up rig includes a hull, a plurality of support legs moveably coupled to the hull, and a ballast tank moveably coupled to each of support legs. Each support leg has a central axis, an upper end, and a lower end opposite the upper end. In addition, the method comprises (b) moving the jack-up rig to an offshore drilling site with the hull floating on the surface of the water after (a). Further, the method comprises (c) positioning the jack-up rig over the offshore drilling with the hull floating on the surface of the water after (b). Still further, the method comprises (d) lowering the plurality of support legs axially downward relative to the hull after (c). Moreover, the method comprises (e) engaging the sea floor with the lower end of each of the support legs during (d). In addition, the method comprises (f) raising the hull above the surface of the water. Further the method comprises (g) lowering each ballast tank at least partially below the surface of the water. The method also comprises (h) filling each ballast tank with water after (g). Moreover, the method comprises (i) raising each ballast tank above the surface of the water after (h).

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
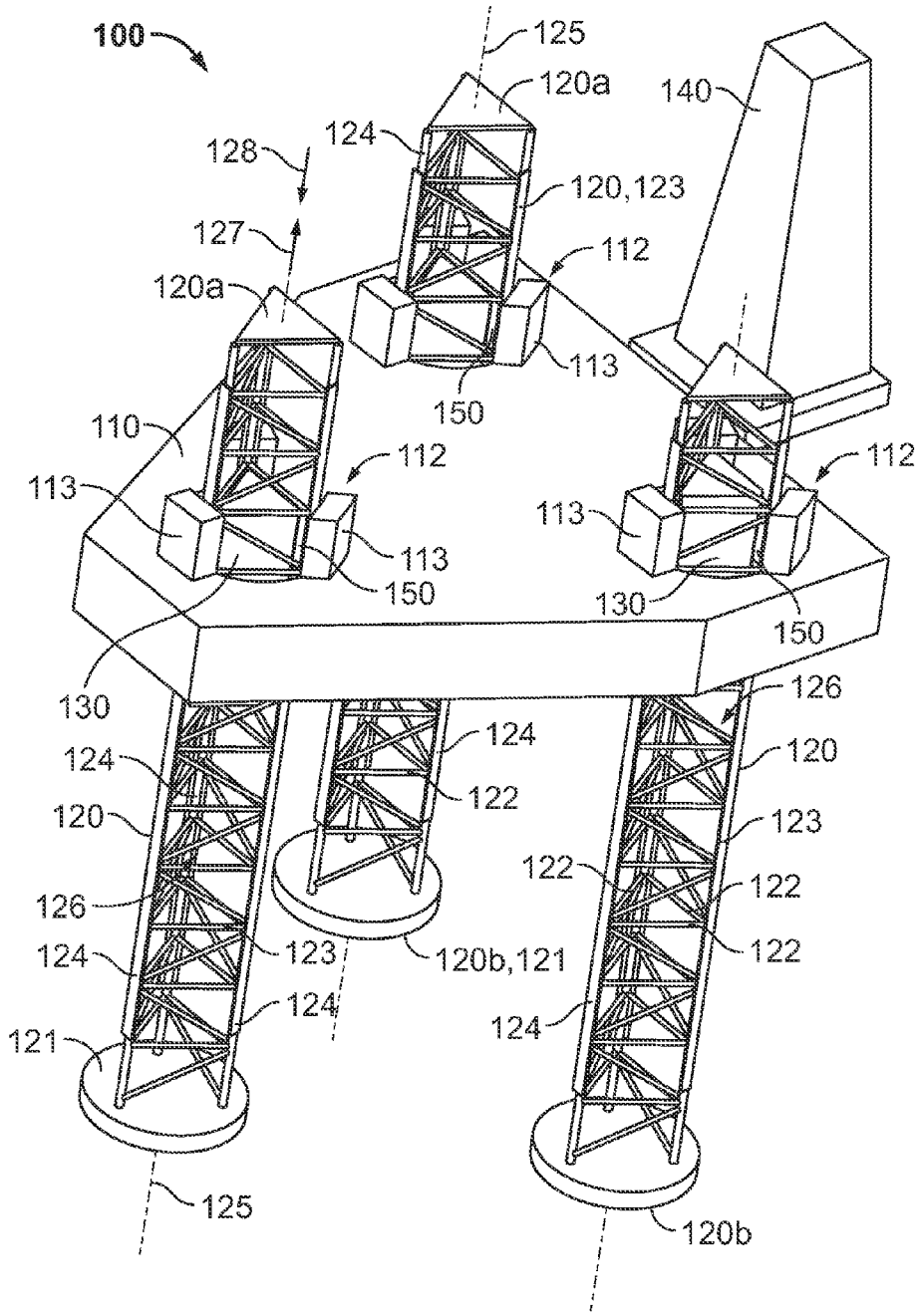
FIG. 1 is a perspective view of an embodiment of a jack-up rig in accordance with the principles described herein including multiple ballast tanks movably connected to the supporting legs.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, an embodiment of a jack-up rig 100 in accordance with the principles described herein is shown. In general, jack-up rig 100 is a structure designed for offshore drilling operations. In this embodiment, jack-up rig 100 includes a buoyant hull 110, a plurality of elongate support legs 120 movably coupled to hull 110, and drilling equipment, such as a derrick 140, supported by hull 110. In this embodiment, rig 100 includes three legs 120, however, in general, any suitable number of legs (e.g., legs 120) may be provided (e.g., four, five, etc.).

Each support leg 120 extends perpendicularly from hull 110 and has a central or longitudinal axis 125, a first or upper end 120*a*, and a second or lower end 120*b* opposite end 120*a*. In this embodiment, lower end 120*b* of each support leg 120 comprises a spud tank 121 configured to engage and penetrate the sea floor during deployment of rig 100. As shown in FIG. 1, each leg 120 comprises a plurality of elongate trusses 122 connected edge-to-edge to form an elongate frame 123 having corners 124 and an open interior 126 extending axially between ends 120*a, b*. Although each frame 123 has a triangular cross-section defined by three trusses 122 in this embodiment, in general, the frame of each leg (e.g., frame 123 of each leg 120) may have any suitable number of trusses (e.g., trusses 122) and cross-sectional geometry including, without limitation, triangular, rectangular, square, circular, etc.

Referring still to FIG. 1, each leg 120 is moveably coupled to hull 110 such that each leg 120 may be independently and controllably moved axially upward and downward relative to hull 110 in the direction of arrows 127, 128, respectively (i.e., up and down parallel to axis 125). In particular, rig 100 includes a plurality of jacking systems 112 configured to raise and lower legs 120. One jacking system 112 is provided for each leg 120, and in this embodiment, each jacking system 112 includes three jacks 113—one jack 113 secured to hull 110 and coupled to one corner 124 of its respective leg 120. In general, each jack 113 may comprise any suitable jacking device known in the art for raising and lowering the legs of a jack-up rig.

For offshore deployment, rig 100 is towed to an offshore drilling location with buoyant hull 110 floating on the water and legs 120 in a "raise" position relative to hull 110. In the raised position, lower ends 120*b* of legs 120 are positioned substantially above the sea floor and upper ends 120*a* of legs are positioned substantially above hull 110. In other words, hull 110 is axially positioned proximal to lower end 120*b* of each leg 120 and distal upper end 120*a* of each leg 120. Once rig 100 is positioned at the desired offshore location (e.g., rig 100 is positioned over the desired drilling location), jacking systems 112 axially lower legs 120 relative to hull 110. Once lower ends 120*b* of legs 120 engage and begin to penetrate the sea floor, jacking systems 112 continue to urge legs 120 axially downward relative to hull 110. As the sea floor begins to resist penetration of legs 120 into the sea floor, continued jacking with systems 112 begins to raise hull 110 axially upward relative to legs 120. As a result, hull 110 is raised out of the water, and thus, may be referred to as a raised platform. Positioning hull 110 above the sea surface 101 allows wave, tidal, and current loads to primarily act on legs 120 (as opposed to the hull 110), thereby offering the potential to enhance the overall stability of rig 100 as legs 120 provide a smaller surface area for the transfer of loads compared to hull 110.

Sufficient penetration of the sea floor with lower ends 120*b* of legs 120 aids in stabilizing and securing the position of rig 100. Accordingly, to ensure sufficient penetration of legs 120 into the sea floor, "preload" (i.e., weight above and beyond the weight of legs 120 themselves) is applied to legs 120. The preload is provided by the weight of hull 110 and equipment supported by hull 110 as it is raised above the sea surface 101. In addition, in embodiments described herein, preload is also provided by a plurality of ballast storage vessels or tanks 130 moveably coupled to legs 120. In particular, one ballast tank 130 is moveably coupled to each leg 120, and contributes preload to its corresponding leg 120. In general, the preload provided by each tank 130 is equal to the dry weight of tank 130 plus any ballast disposed therein. Although solid ballast may be included within one or more tanks 130, they are primarily configured for adjustable water ballast. The preload provided by each tank 130 is directly supported by its corresponding leg 120 and is not borne by hull 110. In this embodiment, ballast preload is provided exclusively by tanks 130. In other words, hull 110 does not include any water ballast tanks. However, in other embodiments, water ballast tanks may also be coupled to or disposed within hull 110 for additional preload.

Without being limited by this or any particular theory, supporting the weight of ballast tanks 130 exclusively with legs 120, as opposed to hull 110, reduces the loads on hull 110, thereby allowing additional equipment, quarters, materials, etc. to be placed on hull 110. Accordingly, the loading specifications for jack-up rig 100 may be upgraded to allow for greater loads. In addition, supporting the weight of ballast tanks 130 exclusively with legs 120, as opposed to hull 110, also offers the potential to free up space inside or on hull 110 and reduce stresses on jacking systems 112 (since jacking systems 112 do not need to lift the preload provided by tanks 130).

For example, a typical jack-up rig using an NS 150 jacking system has a normal lifting load per pinion of 440 Kips, while the maximum rig ballasted load is 700 Kips per pinion. Most jack-up rigs are designed to carry these loads using twelve or eighteen drives per leg. Since the ratings for each drive are typically 440 Kips for normal lifting and 700 Kips for maximum preloading, there are potentially 260 Kips per drive that may be transferred from the hull to the legs. The weight of any ballast tanks in the hull cut into the 260 Kips per drive that could otherwise be used for additional equipment or quarters on the hull.

Referring still to FIG. 1, in this embodiment, each ballast tank 130 is positioned within frame 123 of its corresponding leg 120 and may be axially raised and lowered within interior 126 relative to its corresponding leg 120 and hull 110. In particular, a translation mechanism 150 described in more detail below is provided for each leg 120 to axially move its respective tank 130 up and down within frame 123. In this embodiment, each translation mechanism 150 is positioned between frame 123 and tank 130 of its corresponding leg 120. A locking mechanism may also be provided for each leg 120 to lock the axial position of its corresponding tank 130 relative to frame 123 once the desired axial position is achieved. Although each tank 130 is generally triangular in this embodiment, in general, each tank 130 may have any suitable geometry including, without limitation, cylindrical, triangular, rectangular, etc.

Figure 2:
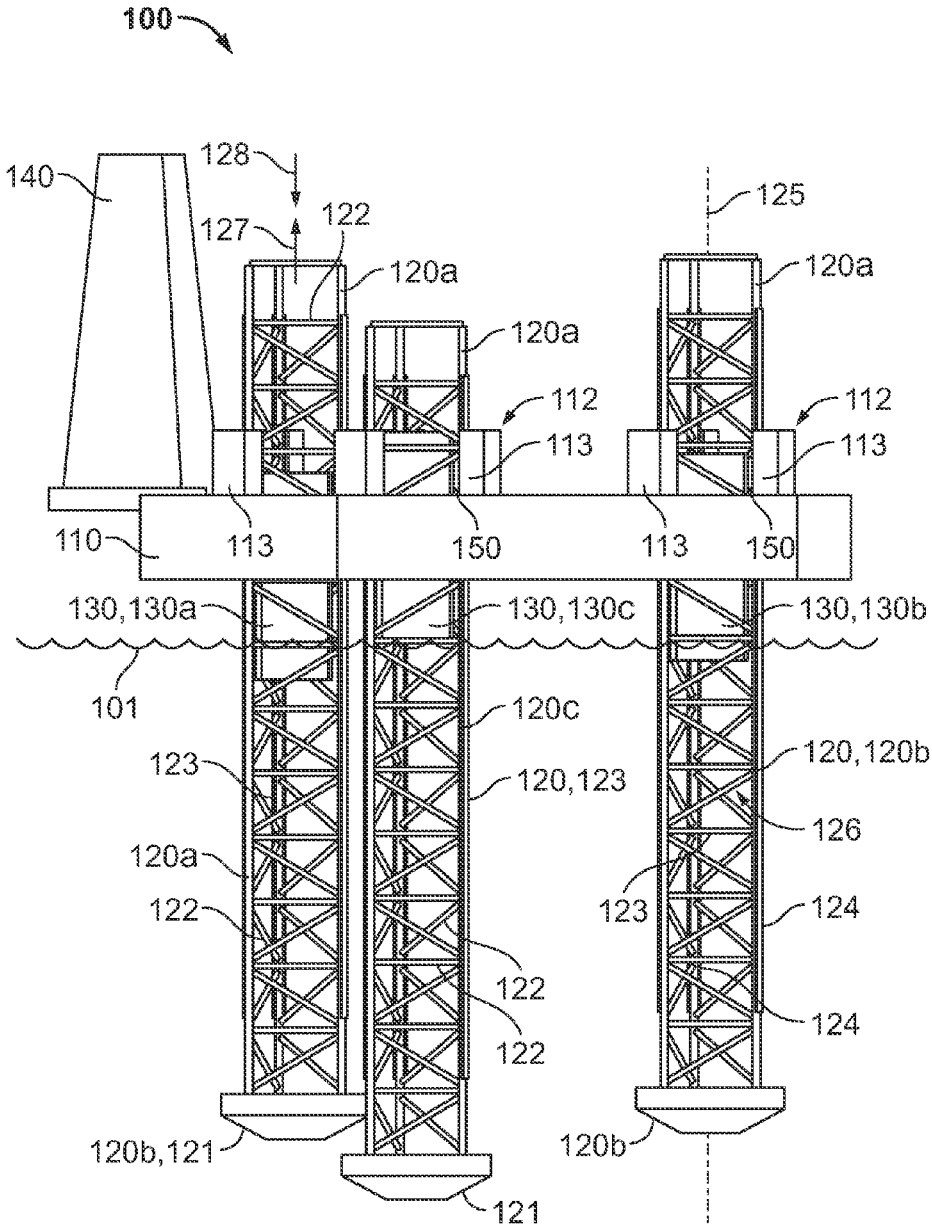
FIGS. 2 and 3 are side views of the jack-up rig of FIG. 1 illustrating possible positions for the ballast tanks.

Referring now to FIG. 2, to deploy legs 120 and set rig 100 at the offshore drilling location, legs 120 are axially lowered relative to hull 110 with jacking systems 112 until ends **120*b* engage and begin to penetrate the sea floor. Ballast tanks 130 are then utilized to add ballast preload to legs 120 and enhance penetration of legs 120 into the sea floor. Specifically, ballast tanks 130 are axially positioned below the sea surface 101 with translation mechanisms 150 and are filled with sea water. Although pumps may be used to facilitate the filling of tanks 130 with sea water, since tanks 130 are axially moveable below the sea surface 101, each tank 130 may simply include an opening or port at its upper end that simultaneously allows sea water to flood the tank 130 and air to exit the tank 130. For additional control, the tank 130 may include a water inlet with a valve that controls the flow of water into the tank 130, and an air outlet with a valve that controls the flow of air out of tank 130**.

To increase the ballast preload applied to its respective leg 120, after each tank 130 is filled with the desired volume of water, it is axially raised with translation mechanism 150 relative to hull 110 and its corresponding leg 120 and until it is positioned at least partially above the sea surface 101. The amount of ballast preload (e.g., lbs) applied to each leg 120 may be varied by adjusting the axial position of its corresponding tank 130 relative to the sea surface 101 with translation mechanism 150. For example, the portion of water in each tank 130 disposed below sea surface 101 is buoyant neutral, and thus, does not contribute preload to its corresponding leg 120. However, the portion of water in each tank 130 positioned above sea surface 101 contributes preload to its corresponding leg 120. Thus, the degree to which ballast tanks 130, and the water therein, are displaced above sea surface 101 determines the amount of preload applied to legs 120 by tanks 130. The maximum preload provided by a given tank 130 is achieved when that tank 130 is raised completely above the sea surface 101, and the minimum preload provided by a given tank 130 is achieved when that tank 130 is completely submerged below the sea surface 101. In fact, as will described in more detail below, a completely submerged tank 130 that includes some air may provide buoyant force and lift as opposed to preload.

In the manner described, the position of each tank 130 relative to the sea surface 101 may be varied with its corresponding translation mechanism 150 to adjust and control the preload provided by the tank 130. It should also be appreciated that the amount of water in each ballast tank 130 may also be varied to adjust and control the preload provided by the tank 130. For example, the greater the volume of water in a given tank 130, the greater the maximum preload it can apply to its corresponding leg 120. Thus, by controlling the position of each ballast tank 130 relative to the sea surface 101 as well as the amount of water in each ballast tank 130, embodiments described herein offer the potential for precise adjustment of the ballast preloads applied to each leg 120 by its corresponding tank 130.

As shown in FIG. 2, ballast tanks 130 are disposed at different axial positions relative to the sea surface 101, hull 110, and legs 120. Assuming that each ballast tank 130 is the same size and contains the same volume of water (i.e., each ballast tank 130 has the same total weight), the differing heights of tanks 130 relative to the sea surface 101 may result in the application of differing amounts of preload on legs 120. For example, assuming that each ballast tank 130 has the same total weight, a first of the ballast tanks 130 (labeled **130*a* in FIG. 2) exerts a portion of its total weight on its corresponding leg 120 (labeled 120*a* in FIG. 2) since tank 130*a* is partially disposed below the sea surface 101; a second of the ballast tanks 130 (labeled 130*b* in FIG. 2) exerts a greater portion of its total weight on its corresponding leg 120 (labeled 120*b* in FIG. 2) as compared to tank 130*a*, since tank 130*b* is positioned somewhat higher than first ballast tank 130*a*, while still being partially submerged; and a third ballast tank 130 (labeled 130*c* in FIG. 2) exerts the maximum amount of weight on its corresponding leg (labeled 120*c* in FIG. 2) since tank 130*c* is completely positioned above the sea surface 101**.

As previously described, during deployment of legs 120, tanks 130 may be filled with water and moved axially up and down relative to the sea surface 101 to provide varying amounts of ballast preload to legs 120. In this embodiment, tanks 130 may also be filled (partially or completely) with air to apply buoyant forces and associated lift to legs 120 to enable faster retrieval of legs 120, thereby reducing the lifting loads required by jacking systems 112 when raising legs 120 from the sea floor.

To apply buoyant forces to a given leg 120 with its corresponding tank 130, the tank 130 is partially or completely filled with air (e.g., air may be pumped into tank 130) and is positioned such that at least a portion of the air in the tank 130 is disposed and maintained below the sea surface 101. In general, a tank 130 may be filled with air before or after it is lowered subsea with translation mechanism 150. The locking mechanism previously described and/or translation mechanism 150 may be used to ensure at least a portion of the air in tank 130 remains below the sea surface 101. It should be appreciated that as legs 120 are raised relative to hull 110 and the sea surface 101, tanks 130 locked thereto are also raised relative to hull 110 and the sea surface 101. Thus, to ensure at least a portion of the air in tanks 130 remains positioned below the sea surface 101 as legs 120 are raised, tanks 130 are preferably locked at an axially positioned along legs 120 that remains subsea during the retrieval process, or continuously lowered relative to legs 120 as legs 120 are raised upward.

The amount of buoyancy or lift (e.g., lbs) applied to a leg 120 may be varied by adjusting the axial position of its corresponding tank 130 (at least partially filled with air) relative to the sea surface 101 with translation mechanism 150. For example, the portion of air in each tank 130 disposed above sea surface 101 is buoyant neutral, and thus, does not provide any lift to its corresponding leg 120. However, the portion of air in each tank 130 positioned below sea surface 101 contributes lift to its corresponding leg 120. Thus, the degree to which ballast tanks 130, and the air therein, are displaced above sea surface 101 determines the amount of lift applied to legs 120 by tanks 130. The maximum lift provided by a given tank 130 is achieved when that tank 130 is completely submerged below the sea surface 101 (i.e., all of the air in the tank 130 is disposed below the sea surface 101), and the minimum lift provided by a given tank 130 is achieved when that tank 130 is completely raised above the sea surface 101 (all of the air in the tank is disposed above the sea surface 101).

In the manner described, the position of each tank 130 (at least partially filled with air) relative to the sea surface 101 may be varied with its corresponding translation mechanism 150 to adjust and control the lift provided by the tank 130. It should also be appreciated that the volume of air in each ballast tank 130 may also be varied to adjust and control the lift provided by the tank 130. For example, the greater the volume of air in a given tank 130, the greater the maximum lift it can apply to its corresponding leg 120. Thus, by controlling the position of each ballast tank 130 relative to the sea surface 101 as well as the volume of air in each ballast tank 130, embodiments described herein offer the potential for precise adjustment of the lift applied to each leg 120 by its corresponding tank 130.

In embodiments where tanks 130 are configured to hold air and provide buoyancy, tanks 130 do not include any ports or openings that could allow the air to escape. Accordingly, in such embodiments, the sea water is preferably controllably pumped into and out of tanks 130 during deployment of legs 120.

Figure 3:
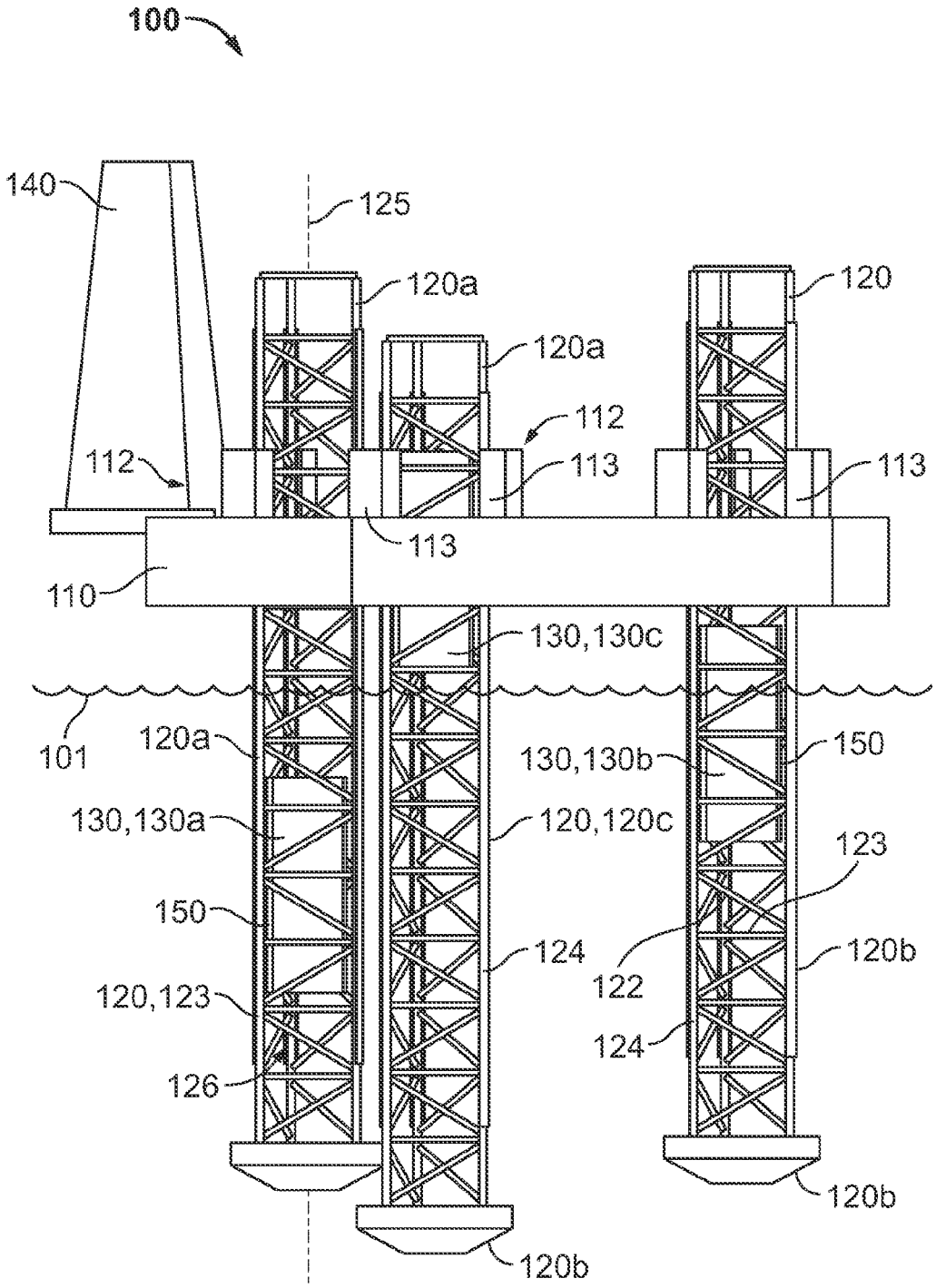

Referring now to FIG. 3, ballast tanks 130, which are filled with air, are shown at different axial heights relative to the sea surface 101. Assuming each tank 130 is the same size has the same dry weight, and includes the same volume of air, tanks 130 exert different amounts of lift, and in some cases apply preload, on their respective legs 120. For example, assuming that each ballast tank 130 is the same size, has the same dry weight, and is completely filled with air, ballast tank 130*a* exerts the maximum amount of lift on leg 120*a* since tank 130*a* is completely submerged below sea surface 101 (i.e., all the air in tank 130*a* is disposed below the sea surface 101); second ballast tank 130*b* exerts less lift on leg 120*b* since it is not completely submerged (i.e., only a portion of the air in tank 130*b* is disposed below the sea surface 101); and a third ballast tank 130*c* exerts the minimum amount of lift on leg 120*c* since it is raised completely above the sea surface 101. In particular, tank 130*c* provides no lift to leg 120*c* and actually exerts preload on leg 120*c* equal to the dry weight of tank 130*c* itself.

In general, any suitable method may be employed to fill each ballast tank 130 with air. For example, each tank 130 may include a water outlet valve in its lower end that is opened as tank 130 is raised above the sea surface 101 to allow water to drain therefrom, and then closed when tank 130 includes the desired volume of air and water. Alternatively, with tank 130 above or below the sea surface 101, air could be pumped into tank 130 with a water outlet valve open, thereby allowing water to be displaced by the air and exit through the open valve. When tank 130 includes the desired volume of air and water, the water outlet valve could then be closed.

Figure 4:
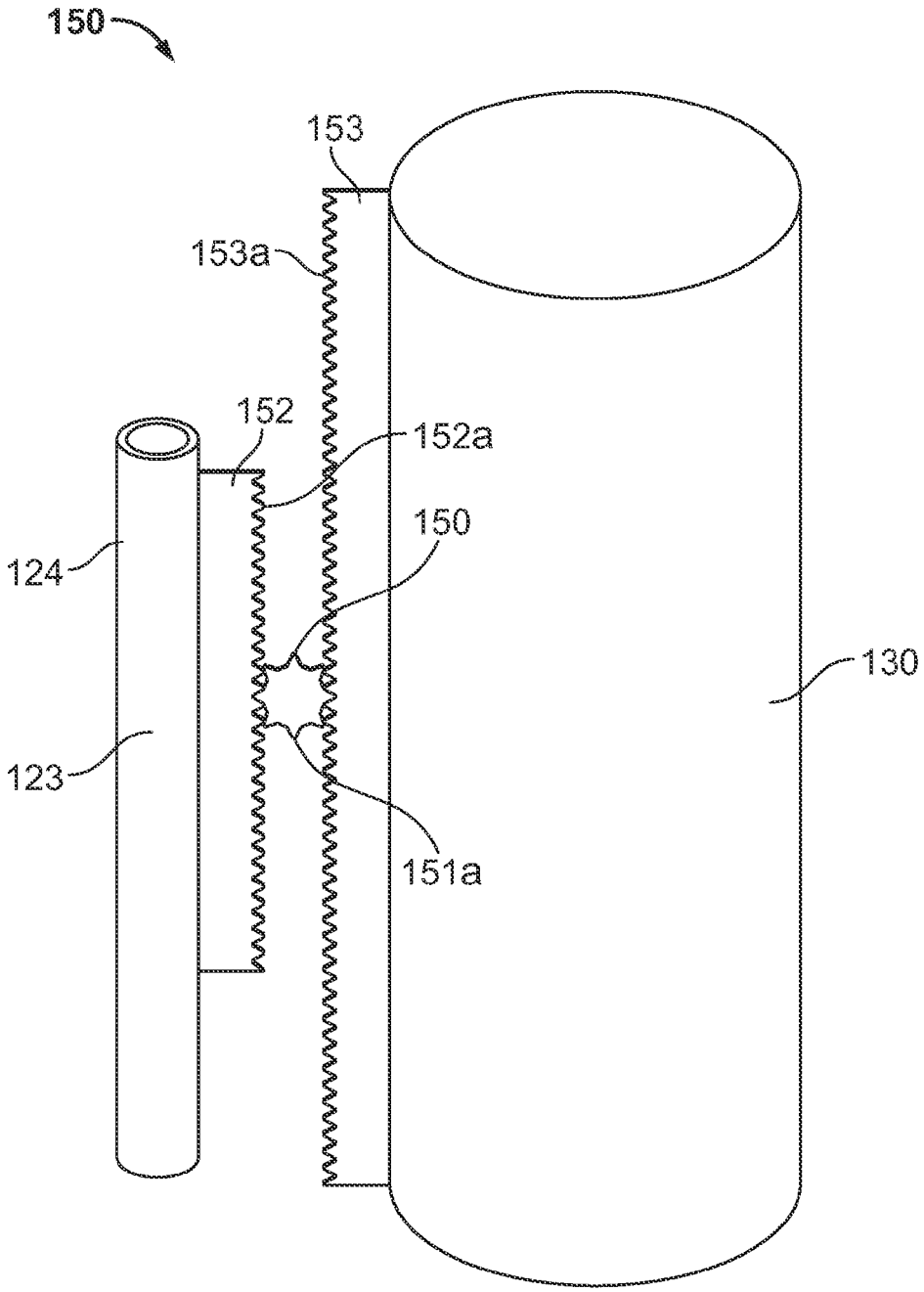
FIG. 4 is a perspective view of the translation mechanism of FIG. 1.

Referring now to FIG. 4, an embodiment of a translation mechanism 150 for axially raising and lowering one ballast tank 130 relative to its respective leg 120 is shown. Although one translation mechanism 150 is shown in FIG. 4, each translation member 150 of a rig (e.g., rig 100) may be configured the same. In this embodiment, translation mechanism 150 comprises a rack and pinion device including a rotatable pinion 151, an elongate leg rack 152 attached to the radially inner surface of one corner 124 of frame 123, and an elongate tank rack 153 attached to the outside of tank 130. To facilitate the axial movement of tank 130 relative to its corresponding leg 120, racks 152, 153 are each oriented parallel to axis 125.

Pinion 151 includes a plurality of teeth 151*a* that engage mating teeth 152*a*, 153*a* of racks 152, 153, respectively. As pinion 151 rotates, tank 130 is displaced axially relative to frame 123 and leg 120. Since pinion 151 engages both racks 152, 153 as it rotates, the axial displacement of rack 153 and tank 130 relative to rack 152 and frame 123 is twice the axial displacement of pinion 151 relative to rack 152 and frame 123. In general, pinion 151 may be rotated by any suitable means. For example, pinion 151 may self-propelled (e.g., driven with an electric, hydraulic, or pneumatic motor). As another example, pinion 151 may be urged axially up and down relative to frame 123 (e.g., by mechanical or hydraulic cylinders, winches with appropriate tackle, etc.) to induce rotation of pinion 151 relative to racks 152, 153. It should also be appreciated that translation mechanism 150 may also function as a locking mechanism to fix or lock the axial position of tank 130 relative to frame 123. For example, if the axial position of pinion 151 relative to frame 123 is fixed and/or pinion 151 is not permitted to rotate relative to frame rack 152, the axial position of tank rack 153 and tank 130 relative to frame 123 will also be fixed or lock in place. In this embodiment, translation mechanism 150 includes only one rack 152 coupled to frame 123 at one corner 124 and a single rack 153 coupled to tank 130. To ensure tank 130 moves smoothly up and down in an axial direction relative to frame 123, one or more guide assemblies may be positioned between tank 130 and frame 123. For example, be a non-driven wheel mounted to tank 130 may be disposed within a mating track mounted to frame 123 to ensure tank 123 does not wobble or tilt excessively as it is moved up and down within frame 123 with translation mechanism 150.

As previously described, in FIG. 4, translation mechanism 150 includes only one rack 152 mounted to frame 123, one rack 153 mounted to tank 130, and one pinion 151 rotatably disposed therebetween. However, in other embodiments, the translation mechanism may include multiple tank racks mounted to the tank, multiple frame racks mounted to the leg frame, and multiple pinions rotatably disposed between each set of opposed frame and tank racks. For example, referring now to FIG. 5, an embodiment of a translation mechanism 160 that may be used in the place of translation mechanism 150 to axially raise and lower one ballast tank 130 relative to its respective leg 120 is shown. In this embodiment, translation mechanism 160 comprises a rack and pinion device including a plurality of pinions 151 as previously described, a plurality of leg racks 152 as previously described, and a plurality of tank racks 153 as previously described. One rack 152 attached to the radially inner surface of each corner 124 of frame 123, racks 153 are circumferentially disposed about the outer surface of tank 130, each rack 153 opposite one rack 152, and a plurality of pinions 151 are rotatably disposed between each set of opposed racks 152, 153. In this embodiment, ballast tank 130 has a triangular geometry with one rack 153 disposed at each corner of tank 130.

Similar to translation mechanism 150 previously described, as each pinion 151 rotates, tank racks 153 are axially displaced twice the axial displacement of pinions 151 relative to racks 152 and frame 123. In addition, pinions 151 may be self-propelled or moved vertically by application of an axial force (upward or downward). Translation mechanism 160 may also act as a locking mechanism in the same manner as translation mechanism 150 previously described. One of skilled in the art will recognize that the rack and pinion mechanisms illustrated in FIGS. 4 and 5 (e.g., mechanisms 150, 160) may reconfigured and/or modified in various respects without departing from the principles disclosed herein.

Figure 6:
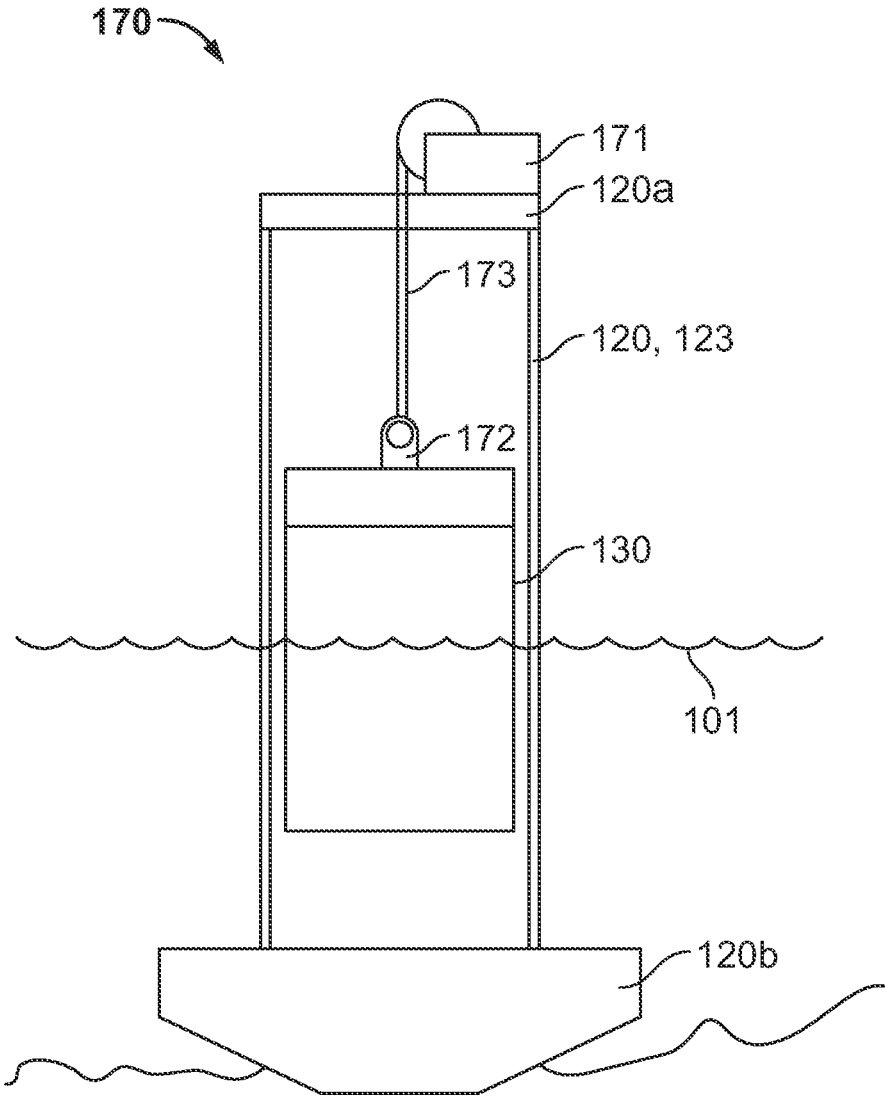
FIG. 6 is a schematic side view of a leg of a jack-up rig including an embodiment of a translation mechanism in accordance with the principles described herein.

Referring now to FIG. 6, another embodiment of a translation mechanism 170 that may be used in the place of translation mechanism 150 to axially raise and lower a ballast tank 130 relative to its respective leg 120 is shown. In this embodiment, translation mechanism 170 comprises a winch 171 secured to upper end 120*a* of leg 120, a mounting bracket 172 secured to the upper end of ballast tank 130, and a cable 173 extending between winch 171 and bracket 172. Rotation of winch 171 in a first direction unwinds cable 173 and allows tank 130 to move axially downward within leg 120, and rotation of winch 171 in the opposite direction winds-up cable 173 and lifts tank 130 axially upward. Since cable 173 only applies axial forces to tank 130 when cable 173 is in tension, translation mechanism 170 is preferred for use in embodiments where ballast tank 130 is not relied on to provide buoyant lift to leg 120.

Once the ballast tank 130 is disposed at the desired axial position relative to leg 120, tank 130 may be locked into place with any suitable locking mechanism including, without limitation, locking pins, locking gears and teeth, pneumatic or hydraulic locking devices, or the like.

Embodiments described also comprise a control system that coordinates and independently controls the following operations: (1) the axial translation of each ballast tank 130 along its corresponding leg 120; (2) the locking of the axial position of each tank 130 relative to its corresponding leg 120; (3) the filling of each ballast tank 130 with water to provide desired ballast; and (4) the filling of each ballast tank 130 with air to provide desired buoyancy and associated lift. Each of these operations may be manually or automatically controlled with the control system locally (e.g., from hull 110) or remotely (e.g., from a location remote rig 100).

Figure 5:
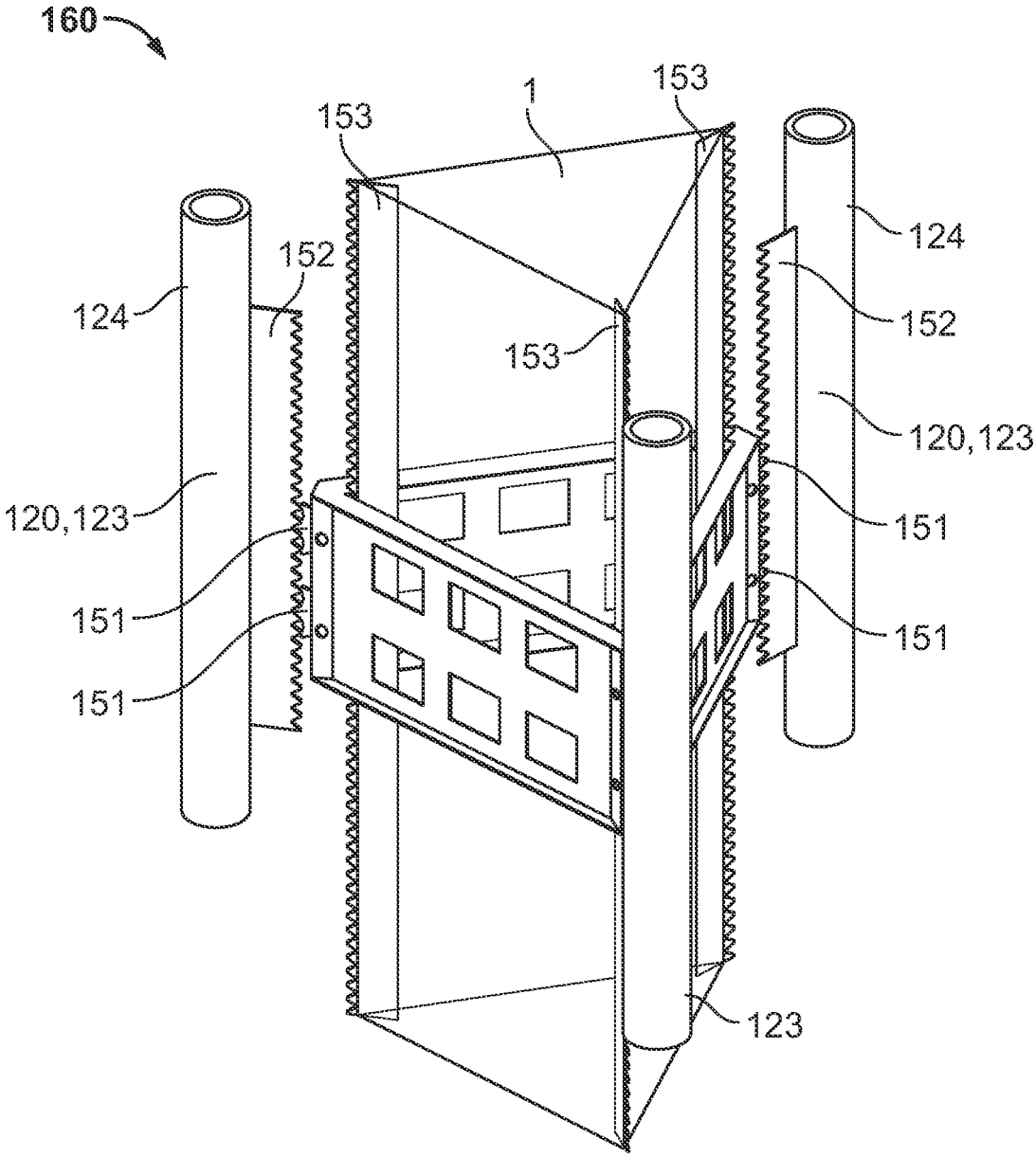
FIG. 5 is a perspective view of an embodiment of a translation mechanism in accordance with the principles described herein.

In the embodiments of translation mechanism 150, 160, 170 shown in FIGS. 4-6, a rack and pinion system or winch system is employed to adjust and control the axial position of a tank 130 relative to its corresponding leg 120. However, other suitable types of translation mechanisms may be employed to raise and lower a tank 130 relative to its corresponding leg 120. Such alternative translation mechanisms may utilize hydraulic or pneumatic cylinders, roller chains and sprockets, or the like, to axially translate the ballast tanks 130 along the legs 120. Some translation mechanisms may function to both axially move and lock a tank 130 relative to its corresponding leg 120.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A jack-up rig for offshore operations, comprising:

a hull;

a support leg moveably coupled to the hull, wherein the support leg has a central axis, an upper end, and a lower end opposite the upper end, and wherein the support leg is adapted to be axially raised and lowered relative to the hull;

a ballast tank movably coupled to the support leg, wherein the ballast tank is configured to be axially raised and lowered relative to the support leg and the hull; and a translation mechanism coupled to the support leg and the ballast tank, wherein the translation mechanism is configured to move the ballast tank axially relative to the support leg in a first direction toward the upper end of the support leg and in a second direction toward the lower end of the support leg;

wherein the translation mechanism is configured to move the ballast tank axially relative to the support leg to a position between the upper end and the lower end of the support leg to apply a ballast preload to the support leg to urge the support leg axially downward.

2. The jack-up rig of claim 1, wherein the ballast tank is disposed within the support leg.

3. The jack-up rig of claim 1, wherein the translation mechanism comprises a winch assembly.

4. The jack-up rig of claim 3, wherein the winch assembly includes a winch mounted to the upper end of the support leg, a mounting member coupled to the ballast tank, and a cable extending from the mounting member to the winch.

5. The jack-up rig of claim 1, wherein the translation mechanism comprises a rack and pinion device.

6. The jack-up rig of claim 5, wherein the translation mechanism includes an elongate leg rack attached to the support leg, an elongate tank rack attached to the tank and radially opposed the leg rack, and a pinion radially positioned between the leg rack and the tank rack;

wherein the leg rack and the tank rack are each oriented parallel to the central axis of the support leg;

wherein the pinion is rotatable relative to the leg rack and the tank rack;

wherein the pinion includes a plurality of teeth that engage a plurality of mating teeth on the leg rack and a plurality of mating teeth on the tank rack.

7. The jack-up rig of claim 1, wherein the translation mechanism includes a plurality of elongate leg racks attached to the support leg, a plurality of elongate tank racks attached to the tank, and a plurality of pinions;

wherein each leg rack and each tank rack is oriented parallel to the central axis of the support leg;

wherein each leg rack is radially opposed one of the tank racks;

wherein at least one of the plurality of pinions is radially positioned between one leg rack and one tank rack;

wherein each pinion is rotatable relative to the leg racks and the tank racks;

wherein each pinion includes a plurality of teeth that engage a plurality of mating teeth on one of the leg racks and one of the tank racks.

8. The jack-up rig of claim 1, wherein the translation mechanism is adapted to lock the axial position of the ballast tank relative to the support leg.

9. A method for operating an offshore jack-up rig including a hull and a plurality of elongate support legs moveably coupled to the hull, each of the support legs having a central axis, an upper end, and a lower end opposite the upper end, the method comprising:

(a) moveably coupling a ballast tank to a first of the plurality of support legs;

(b) moving the first of the plurality of support legs axially down relative to the hull; and (c) at least partially filling the ballast tank with water;

(d) raising the ballast tank axially up relative to the first of the plurality of support legs to a position above the lower end of the first of the plurality of support legs and at least partially above the sea surface after (c);

(e) increasing a downward preload applied to the first of the plurality of support legs during (c) to urge the lower end of the first of the plurality of support legs into the sea floor, wherein the preload applied by the ballast tank is not applied to the hull.

10. The method of claim 9, further comprising:

moving the jack-up rig to an offshore location with the hull floating on the surface of the water before (b).

11. The method of claim 9, further comprising:

lifting the first of the plurality of support legs axially upward relative to the hull; and at least partially filling the ballast tank with air and axially lowering the ballast tank below the sea surface.

12. The method of claim 9, wherein the ballast tank is moved axially up or down relative to the first of the plurality of support legs with a translation mechanism.

13. The method of claim 12, wherein the translation mechanism includes a leg rack attached to the first of the plurality of legs, a tank rack attached to the tank radially opposite the leg rack, and a pinion positioned between the leg rack and the tank rack.

14. The method of claim 13, wherein (d) comprises engaging the leg rack and the tank rack with the pinion, and rotating the pinion relative to the leg rack and the tank rack.

15. The method of claim 12, further comprising:

attaching a winch to the upper end of the first of the plurality of support legs;

coupling a cable to the winch and the ballast tank; and using the winch to axially raise or lower the ballast tank relative to the first of the plurality of support legs.

16. A method for deploying an offshore jack-up rig, comprising:

(a) building the jack-up rig, wherein the jack-up rig includes a hull, a plurality of support legs moveably coupled to the hull, and a ballast tank moveably coupled to each of support legs; wherein each support leg has a central axis, an upper end, and a lower end opposite the upper end;

(b) moving the jack-up rig to an offshore drilling site with the hull floating on the surface of the water after (a);

(c) positioning the jack-up rig over the offshore drilling with the hull floating on the surface of the water after (b);

(d) lowering the plurality of support legs axially downward relative to the hull after (c);

(e) engaging the sea floor with the lower end of each of the support legs during (d);

(f) raising the hull above the surface of the water;

(g) lowering each ballast tank at least partially below the surface of the water;

(h) filling each ballast tank with water after (g); and (i) raising each ballast tank above the surface of the water after (h).

17. The method of claim 16, further comprising (i) penetrating the sea floor with the lower end of each support leg during (h).

18. The method of claim 16, further comprising applying a ballast preload to each support leg with its corresponding ballast tank during (h) without applying the ballast preload to the hull.

19. The method of claim 16, wherein each ballast tank is disposed within its corresponding support leg.

* * * * *